US009828993B2

(12) United States Patent
Itou et al.

(10) Patent No.: US 9,828,993 B2
(45) Date of Patent: Nov. 28, 2017

(54) ROTARY FLUID MACHINE

(71) Applicant: Hitachi, Ltd., Chiyoda-ku, Tokyo (JP)

(72) Inventors: Takahiro Itou, Tokyo (JP); Tadashi Osaka, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 208 days.

(21) Appl. No.: 14/764,104

(22) PCT Filed: Jan. 29, 2013

(86) PCT No.: PCT/JP2013/051844
§ 371 (c)(1),
(2) Date: Jul. 28, 2015

(87) PCT Pub. No.: WO2014/118876
PCT Pub. Date: Aug. 7, 2014

(65) Prior Publication Data

US 2015/0322945 A1 Nov. 12, 2015

(51) Int. Cl.
*F01C 1/24* (2006.01)
*F03C 2/00* (2006.01)
(Continued)

(52) U.S. Cl.
CPC ..... *F04C 15/0019* (2013.01); *F01C 21/108* (2013.01); *F04C 2/18* (2013.01);
(Continued)

(58) Field of Classification Search
CPC . F04C 15/0019; F04C 15/0026; F01C 21/108
(Continued)

(56) References Cited

U.S. PATENT DOCUMENTS 2,707,441 A * 5/1955 Drennen ..... F04C 2/14 418/132
3,050,010 A * 8/1962 Thrap ..... F04C 15/0026 418/132

(Continued)

FOREIGN PATENT DOCUMENTS

| | | | |
|---|---|---|---|
| JP | 8-42461 | A | 2/1996 |
| JP | 9-287576 | A | 11/1997 |
| JP | 10-252589 | A | 9/1998 |
| JP | 11-303768 | A | 11/1999 |
| JP | 2000-64967 | A | 3/2000 |
| JP | 2009-216070 | A | 9/2009 |
| JP | 2012-17743 | A | 1/2012 |

OTHER PUBLICATIONS

International Search Report (PCT/ISA/210) dated Apr. 16, 2013 with English-language translation (four (4) pages).

*Primary Examiner* — Mark Laurenzi
*Assistant Examiner* — Deming Wan
(74) *Attorney, Agent, or Firm* — Crowell & Moring LLP

(57) ABSTRACT

A rotary fluid machine that reduces fluid leakage from a gear pump or gear motor and achieves improvement in responsiveness is provided. The present invention is configured such that force of pressing a side plate toward gears by a seal member provided between the side plate and a case and performing pressure compartment is partly strong, not uniform along the entire length of the seal member. Specifically, for example, a gear pump comprises an assembly including a pair of gears, a side plate sealing a side surface of the gears, and a seal block sealing tooth tips of the gears, a case housing the pump assembly, and a seal member being arranged between the side plate or the seal block and the case and along a notch portion formed in the side plate or the seal block. The seal member is wider at a portion in a position passing through a place with large pressure fluctuations than at other portions.

18 Claims, 10 Drawing Sheets

(51) Int. Cl.

| | |
|---|---|
| ***F04C 18/08*** | (2006.01) |
| ***F01C 19/10*** | (2006.01) |
| ***F04C 15/00*** | (2006.01) |
| ***F01C 21/10*** | (2006.01) |
| ***F04C 2/18*** | (2006.01) |
| *F01C 19/00* | (2006.01) |

(52) U.S. Cl.
CPC ..... *F04C 15/0026* (2013.01); *F04C 15/0034* (2013.01); *F01C 19/005* (2013.01)

(58) Field of Classification Search
USPC ..... 418/139, 132, 133, 125, 206.1, 206.6, 418/104, 149, 117, 131; 277/644, 648, 277/649
See application file for complete search history.

(56) References Cited

U.S. PATENT DOCUMENTS

| | | | | |
|---|---|---|---|---|
| 3,416,459 | A * | 12/1968 | Reimer | F04C 15/0026 418/132 |
| 3,961,872 | A * | 6/1976 | Muller | F04C 15/0026 418/132 |
| 5,022,837 | A * | 6/1991 | King | F04C 15/0026 418/132 |
| 6,047,684 | A | 4/2000 | Hiraku et al. | |
| 2009/0232690 | A1 | 9/2009 | Maruo et al. | |
| 2010/0247362 | A1 | 9/2010 | Koizumi et al. | |

* cited by examiner

ROTARY FLUID MACHINE

TECHNICAL FIELD

The present invention relates to a rotary fluid machine using gears such as a gear pump or a gear motor.

BACKGROUND ART

There is a gear pump used as an oil-pressure source for movable bodies such as construction machines, robots, and automobiles (see JP 10-252589 A (PTL 1)).

In a gear pump disclosed in PTL 1, a pump assembly includes: a pair of gears that have rotary shafts pivotally supported by a gear case and circumscribed and engaged with each other; a pair of side plates that seal side surfaces of the gears; and the pump assembly configured with a seal block that seals tooth tips of the gears in the vicinity of an intake port are housed in the gear cases, and a pressure division seal (seals for dividing pressure into intake pressure on the inside and discharge pressure on the outside) is installed in a groove on end surface of the side plate or the seal block on the gear case side. The pressure division seal is formed from an elastic body such as rubber such that the side plates and the gear side surfaces are brought into light touch with each other by an initial load of the elastic body. The cross section of the pressure division seal is stepped to produce space into which the pressure division seal (rubber) can escape even though the pressure division seal is bulged in the groove.

CITATION LIST

Patent Literature

PTL 1: JP 10-252589 A

SUMMARY OF INVENTION

Technical Problem

The pressure division seal needs to be designed in dimensions such that, taking into account dimensional tolerances for individual components placed in a prescribed position such as a groove or step, the pressure division seal has a margin for crushing and contacts the side plates or the gear cases under contact surface pressure when the gear pump is assembled. In other words, to reliably block a gap between the side plates or the seal block and the gear case, the groove in the side plates or the seal block is designed to be lower than the pressure division seal. Accordingly, after the gear pump is assembled, the pressure division seal is crushed and brought into close contact with the side plates or the seal block while generating a contact surface pressure relative to the inner wall of the gear case.

If the contact surface pressure is insufficient, the pressure division seal is not brought into close contact with the side plates or the gear case, which causes fluid leakage and reduces the volumetric efficiency of the pump. On the other hand, if the margin for crushing of the pressure division seal is increased for secure sealing, the pressure division seal grows in impulsion to increase force of pressing the side plates against the side surfaces of the gears. This also increases a frictional force generated on the side surfaces of the gears, which results in decrease of pressure responsiveness of the pump. Further, since the maximum torque becomes large at driving of the pump, the driving source motor needs to be increased in capacity, which leads to size increase in the entire system.

The gear pump has a section where two gears are engaged. When the two gears contact each other at two places in the section at a rotation angle, there occurs an area that is closed in the section between the tooth grooves in the gears. The closed area varies in volume with rotation of the gears, but the volume of the area is small and large pressure fluctuations take place even with a minor change in volume. Therefore, the side plates provided to sandwich the two gears may be separated from the side surfaces of the gears by force generating from the pressure fluctuations. This may cause a high-pressure area (discharge port side) and a low-pressure area (intake port side) of the pump to communicate with each other to reduce the volumetric efficiency of the pump.

According to the technique of PTL 1, since the cross section of the pressure division seal is stepped, a portion of the pressure division seal to be crushed is thin at the cross section. As a result, it is possible to avoid that force generated by the pressure division seal for pressing the side plates toward the gears after the assembly of the pump is lowered and load torque becomes high due to increase in friction between the side plates and the gears, while securing a sufficient amount of portion of the pressure division seal to be crushed between the side plates or the seal block and the gear case. However, the pressure division seal described in PTL 1 has a cross section uniformly formed along the entire seal length. Accordingly, when the cross section of the pressure division seal is stepped to reduce force of pressing the side plates toward the gears, pressing force becomes weak along the entire seal length. This makes the side plates more prone to be separated from the side surfaces of the gears by force generated from pressure fluctuations, which may further reduce the volumetric efficiency of the pump.

In addition, when the gear pump is configured to seal the tooth tips by the seal block in a relatively short section as described in PTL 1, the high-pressure area varies depending on the rotation angle of the gears. When the high-pressure area is positioned closest to the intake port (low-pressure area), force of separating the side plates from the side surfaces of the gears becomes largest. However, according to the technique described in PTL 1, the cross section of the pressure division seal is uniformly formed along the entire seal length as described above. Thus, when the cross section is stepped to reduce the force of pressing the side plates toward the gears, the force of pressing cannot counteract the force of separating the side plates from the side surfaces of the gears.

When the side plates are to be pressed toward the side surfaces of the gears by force larger than the force of separating the side plates from the side surfaces of the gears to counteract the force of separating, the portion of the pressure division seal to be crushed need to be larger in size. In that case, the force generated by the entire seal becomes large to increase friction, which may cause reduction in responsiveness and efficiency of the pump.

The assembled pump gear may have a gap between the side plates and the gears under influence of a curve or lower surface accuracy of the side plates.

When the side plates are formed of low-rigidity material such as resin, the side plates can be deformed and brought into close contact with the gears by the force generated from the pressure division seal. Meanwhile, when the pressure division seal with a uniform cross section is used, the force of pressing the side plates toward the side surfaces of the gears is generated beyond necessity in places without a gap, thereby increasing friction.

According to the foregoing discussion of the inventors of the present invention, it is difficult with the conventional pressure division seal to reduce fluid leakage from the pump caused by locally acting pressure fluctuations or the like, and improve pressure responsiveness and reduce driving torque while suppressing increase in friction between the side plates or the seal block and the gears. This problem also occurs at gear motors.

An object of the present invention is to provide a rotary fluid machine that reduces fluid leakage from a gear pump or gear motor and achieves improvement in responsiveness.

Solution to Problem

The present invention is configured such that force of pressing a side plate toward gears by a seal member provided between the side plate and a case and performing pressure compartment is partly strong, not uniform along the entire length of the seal member.

Specifically, the foregoing problem is solved by configurations described in the claims.

Advantageous Effects of Invention

According to the present invention, it is possible to reduce fluid leakage from a gear pump or gear motor and achieve improvement in responsiveness.

Problems, configurations, advantages other than those described above will be clarified by the following descriptions of embodiments.

DESCRIPTION OF EMBODIMENTS

Embodiments according to the present invention will be described below with reference to the accompanying drawings. In the following descriptions, the present invention is applied to a gear pump.

First Embodiment

Figure 1:
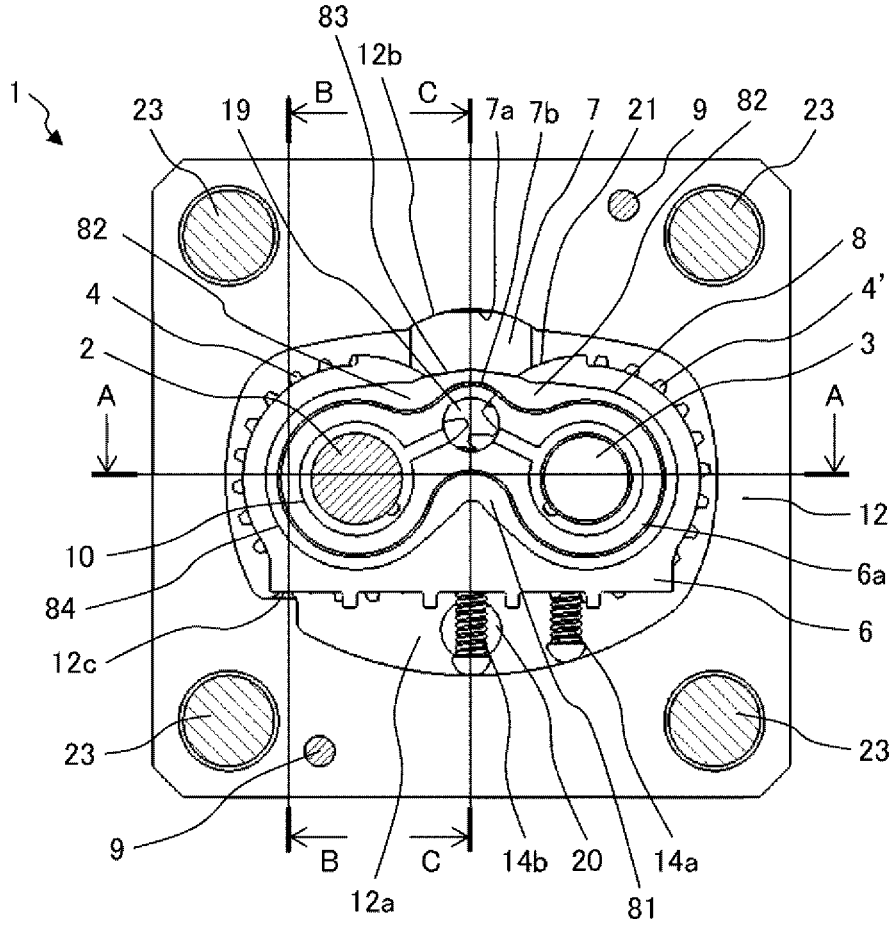
FIG. 1 is a cross-sectional view of a basic configuration of a first embodiment of a gear pump according to the present invention, which is square to a driving shaft.
Figure 2:
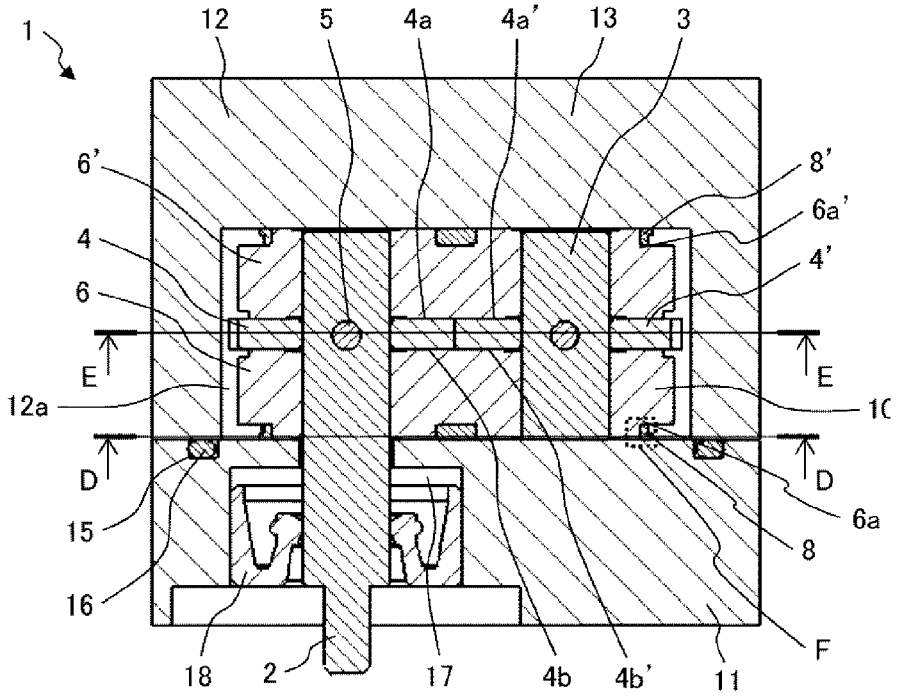
FIG. 2 is a cross-sectional view of the gear pump illustrated in FIG. 1 taken along line A-A.
Figure 3:
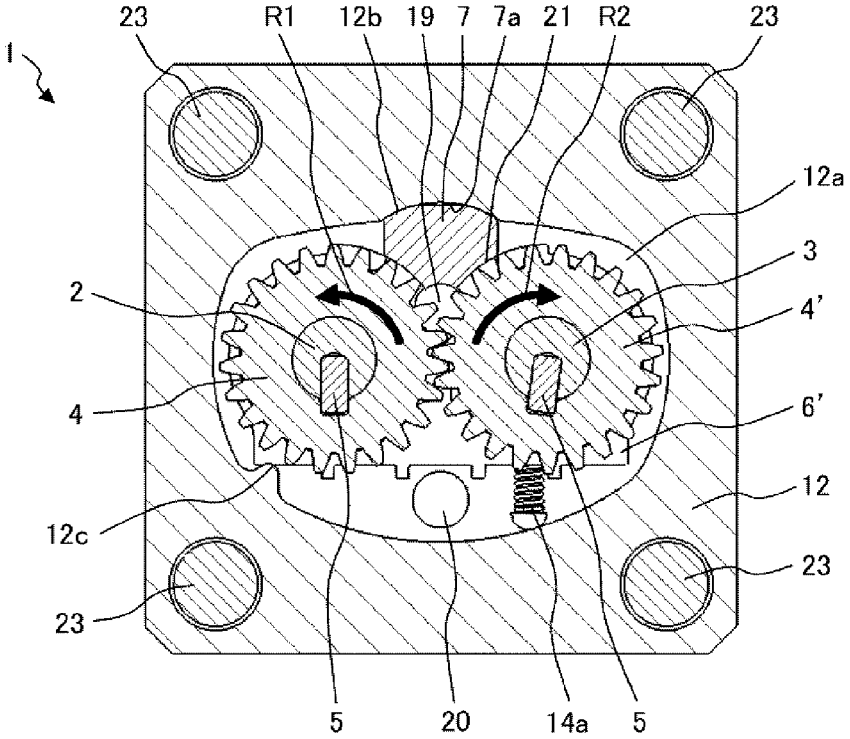
FIG. 3 is a cross-sectional view of the gear pump illustrated in FIG. 2 taken along line E-E.
Figure 4:
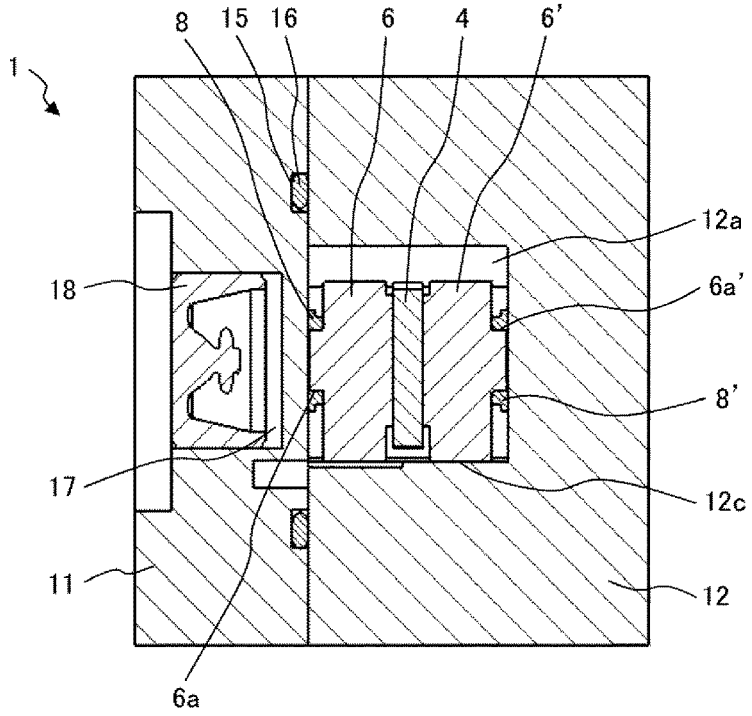
FIG. 4 is a cross-sectional view of the gear pump illustrated in FIG. 1 taken along line B-B.
Figure 5:
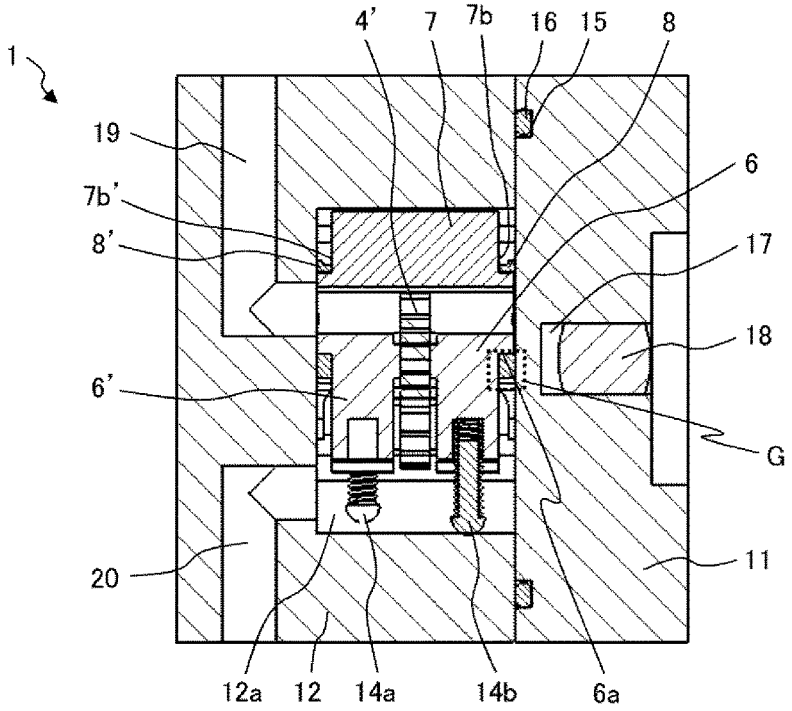
FIG. 5 is a cross-sectional view of the gear pump illustrated in FIG. 1 taken along line C-C.

Referring to FIGS. 1 to 5, a gear pump 1 according to a first embodiment of the present invention will be described. FIG. 1 is a cross-sectional view of a basic configuration of the gear pump 1 with a seal member in the first embodiment of the present invention, which is square to a driving shaft. FIG. 2 is a cross-sectional view of the gear pump illustrated in FIG. 1 taken along line A-A. FIG. 3 is a cross-sectional view of the gear pump illustrated in FIG. 2 taken along line E-E. FIG. 4 is a cross-sectional view of the gear pump illustrated in FIG. 1 taken along line B-B. FIG. 5 is a cross-sectional view of the gear pump illustrated in FIG. 1 taken along line C-C. FIG. 1 is equivalent to a cross-sectional view of the gear pump illustrated in FIG. 2 taken along line D-D.

As illustrated in FIGS. 1 and 2, the gear pump 1 includes a pump assembly 10. The pump assembly 10 includes a drive shaft (driving shaft) 2, a driven shaft (following shaft) 3, a pair of gears 4 and 4', drive pins 5, a pair of side plates 6 and 6', and a seal block 7.

The drive shaft 2 is connected to a driving source such as an external electric motor (not illustrated) and is rotated and driven. The driven shaft 3 is rotated by a rotational force from the drive shaft 2 via the pair of gears 4 and 4'. The pair of gears 4 and 4' is supported by the drive shaft 2 and the driven shaft 3, respectively, to engage with each other at tooth tips as illustrated in FIG. 2. The drive pins 5 are inserted into the two shafts 2 and 3 such that the drive shaft 2, the driven shaft 3, and the gears 4 and 4' rotate integrally as illustrated in FIG. 3. The pair of side plates 6 and 6' are arranged adjacent to both side surfaces of the gears 4 and 4' as illustrated in FIGS. 2 and 4, and have contact surfaces 21 in contact with the seal block 7 as illustrated in FIGS. 1 and 3. The seal block 7 is in contact with the side plates 6 and 6' by the contact surfaces 21 as illustrated in FIGS. 1 and 3, and covers circumferential portions of the gears 4 and 4' as illustrated in FIG. 3 (the seal block 7 is opposed to the tooth tips in the vicinity of the intake port). Specifically, the seal block 7 is approximate to the tooth tips of the gears 4 and 4' in a certain circumferential range of the gears 4 and 4'.

As illustrated in FIG. 2, the side plate 6 is arranged adjacent to a side surface 4*b* of the gear 4 and a side surface 4*b'* of the gear 4', and the side plate 6' is arranged adjacent to a side surface 4*a* of the gear 4 and a side surface 4*a'* of the gear 4'. The side surfaces 4*b* and 4*b'* of the gears 4 and 4' contact slidably the side plate 6, and the side surfaces 4*a* and 4*a'* of the gears 4 and 4' contact slidably the side plate 6'. Accordingly, the side plates 6 and 6' seal the both side surfaces of the gears 4 and 4'.

The side plates 6 and 6' have two each through holes. Inserting the drive shaft 2 and the driven shaft 3 into the through holes of the side plates 6 and 6' allows both the drive shaft 2 and the driven shaft 3 to be supported in parallel and with predetermined spacing therebetween.

The side plates 6 and 6' are formed in the same shape for commonality of components, and have an intake port 19 as an intake distribution hole as illustrated in FIG. 1. The outer edges of the side plates 6 and 6' in the vicinity of the intake port 19 are formed in the shape of an arc almost equal to the outer diameter of circles formed by the tooth tips of the gears 4 and 4' as illustrated in FIG. 3.

The contact surfaces of the seal block 7 relative to the side plates 6 and 6' are shaped in almost the same manner as the arc-shaped portions of the side plates 6 and 6' as illustrated in FIG. 3. As described above, the seal block 7 and the side plates 6 and 6' are in close contact with each other by the contact surfaces 21 of the side plates 6 and 6'.

The pump assembly 10 is housed in a case 13 composed of a front case 11 and a rear case 12 as illustrated in FIG. 2. The front case 11 and the rear case 12 are formed by members different from that of the seal block 7. The rear case 12 has a concave portion 12*a* as illustrated in FIGS. 1 to 5. The front case 11 is attached to a free end of the concave portion 12*a* to form a space for sealing a fluid as illustrated in FIGS. 2, 4, and 5.

As illustrated in FIGS. 2, 4, and 5, the pump assembly 10 has seal members 8 and 8' arranged at steps 6*a* and 6*a'* of the side plates on both end surfaces along the longitudinal side of the drive shaft 2 and at steps 7*b* and 7*b'* of the seal block, and the pump assembly 10 is sandwiched and supported between the front case 11 and the rear case 12 via the seal members 8 and 8'. The front case 11 and the rear case 12 are aligned with each other by knock pins 9 illustrated in FIG. 1, and are tightened by bolts 23. The steps 6*a*, 6*a'*, 7*b*, and 7*b'* are notches at outer peripheral portions of the side plates 6 and 6' and at an inner peripheral portion of the seal block 7. In the present embodiment, notches are formed as the steps 6*a*, 6*a'*, 7*b*, and 7*b'*. Instead of the steps, grooves may be formed in the side plates and the seal block such that the seal members 8 and 8' are arranged in the grooves. The seal members 8 and 8' are formed from an elastic body such as rubber.

The concave portion 12*a* of the rear case 12 is shaped as illustrated in FIGS. 1 and 3, for example, and is configured to house the pump assembly 10 and the seal members 8 and 8' as illustrated in FIGS. 1 to 5.

As illustrated in FIGS. 1 and 3, the concave portion 12*a* of the rear case 12 has a surface 12*b* opposed to the seal block 7, and the surface 12*b* constitutes part of a cylindrical surface (inner peripheral surface of a cylinder extended along the longitudinal side of the drive shaft). The seal block 7 has a surface 7*a* opposed to the concave portion 12*a* of the rear case 12, and the surface 7*a* constitutes part of a cylindrical surface (cylindrical outer peripheral surface extended along the longitudinal side of the drive shaft). Accordingly, the pump assembly 10 has a rotational axis as a straight line parallel to the drive shaft 2 and passing through the center of the arc of the opposed surface 12*b* of concave portion of the rear case as a cylindrical surface, and is rotatably bound around the rotational axis.

The concave portion 12*a* of the rear case 12 is provided with a protrusion 12*c* at one place of the inner wall as illustrated in FIGS. 1 and 3. Referring to FIGS. 1 and 3, the protrusion 12*c* is located at the side opposite to the rotational axis of the pump assembly 10 relative to the drive shaft 2, that is, at the lower left side of the drive shaft 2, in the direction that links the drive shaft 2 and the driven shaft 3 (horizontal direction in FIGS. 1 and 3). However, the position of the protrusion 12*c* illustrated in FIGS. 1 and 3 is a mere example and is not limited to this.

As illustrated in FIG. 4, the protrusion 12*c* contacts one of the two side plates 6 and 6' (the side plate 6' more distant from the front case 11 in FIG. 4) to suppress rotation of the pump assembly 10 around the rotational axis described above. In the present embodiment, the side plate 6' contacts the protrusion 12*c* in the concave portion 12*a* of the rear case 12 on the side opposite to the rotational axis of the pump assembly 10 relative to the drive shaft 2, in the direction that links the drive shaft 2 and the driven shaft 3 (horizontal direction in FIGS. 1 and 3).

As illustrated in FIGS. 1, 3, and 5, energizing members 14*a* and 14*b* are provided to press the side plates 6 and 6' toward the seal block 7. The energizing members 14*a* and 14*b* are elastic bodies and are composed of springs and pins, for example. The energizing members 14*a* and 14*b* are arranged between the side plates 6, 6' and the inner wall of the rear case concave portion 12*a* as illustrated in FIGS. 1, 3, and 5.

The energizing member 14*a* is arranged to rotate the pump assembly 10 in the same direction as a rotational direction R1 of the drive shaft 2 and the gear 4 to press the side plate 6' as illustrated in FIG. 3. Specifically, the energizing member 14*a* is arranged at a position on the side (right side of FIG. 3) opposite to the position of the protrusion 12*c* (left side in FIG. 3) relative to the rotational axis of the pump assembly 10, in the direction that links the drive shaft 2 and the driven shaft 3 (horizontal direction in FIG. 3) to press the side plate 6'. As described above, the side plate 6' is supported by the protrusion 12*c* in the concave portion 12*a* of the rear case 12.

The energizing member 14*b* is arranged at a position on the side (lower side of FIG. 3) opposite to the position of the seal block 7 (upper side in FIG. 3) relative to the rotational axis of the pump assembly 10, in the direction perpendicular to the direction that links the drive shaft 2 and the driven shaft 3 and to the longitudinal side of the drive shaft 2 (vertical direction in FIG. 3) as illustrated in FIG. 1, and presses the side plate 6.

According to the configurations illustrated in FIGS. 1 to 5, the pump assembly 10 is housed in the concave portion 12*a* of the rear case 12 in a manner capable of rotation around the rotational axis. The rotation of the pump assembly 10 is stopped by the energizing member 14*a* pressing the side plate 6' against the protrusion 12*c* in the concave portion 12*a* of the rear case 12. This allows the pump assembly 10 to be positioned in the concave portion 12*a* of the rear case 12. The side plate 6 does not contact the concave portion 12*a* of the rear case 12 but is pressed by the energizing member 14*b* and fixed in position in close contact with the seal block 7 by the contact surface 21.

According to the foregoing configuration, the one side plate 6' takes charge of fixing the position of the pump assembly 10, and the other side plate 6 is fixed in contact with the seal block 7 held by the opposed surface 12*b* of the concave portion 12*a* of the rear case 12. Accordingly, even though the contact surfaces 21 relative to the seal block 7 are slightly different in shape between the two side plates 6 and 6' due to processing error, the one side plate does not inhibit the close contact between the other side plate and the seal block 7.

As illustrated in FIGS. 2, 4, and 5, the front case 11 has grooves 15 on the contact surface relative to the rear case 12. Case seals 16 are arranged in the grooves 15. The case seals 16 are configured to seal a gap possibly produced between the front case 11 and the rear case 12 in the assembled state, thereby to prevent leakage of liquid in the rear case 12 to the outside.

As illustrated in FIGS. 2, 4, and 5, the front case 11 is provided with a concave 17 on the surface opposite to the contact surface relative to the rear case 12 (for example, the lower surface in FIG. 2). An oil seal 18 is arranged in the concave 17. When the oil seal 18 is pressed and fitted into the concave 17 of the front case 11, the outer peripheral surface of the oil seal 18 is brought into close contact with the wall surface of the concave 17 and the outer peripheral surface of the drive shaft 2 contacts slidably with the inner peripheral surface of the oil seal 18. Accordingly, the oil seal 18 seals the gap between the drive shaft 2 and the front case 11 to prevent leakage of the liquid in the pump chamber to the outside at driving of the gear pump.

The intake port 19 is formed by the side plates 6, 6', the seal block 7, and the rear case 12 as illustrated in FIG. 5. In addition, a discharge port 20 is formed by a flow path in the rear case 12. The discharge port 20 communicates with the concave portion 12*a* of the rear case 12 as illustrated in FIGS. 1, 3, and 5.

A tank (not illustrated) or the like is connected to upstream of the intake port 19 to supply liquid to the gear pump 1. A valve and cylinder (not illustrated) are connected to downstream of the discharge port 20 to adjust a pump discharge pressure. A driving source such as a motor (not illustrated) is connected to the drive shaft 2.

When the gear pump 1 is driven, a high-pressure area and a low-pressure area are formed in the concave portion 12*a* of the rear case 12. The high-pressure area and the low-pressure area are defined by components described below. Seals by the components will be described. The gear pump 1 has seal members 8 and 8' arranged to a seal engaged portion between the gears 4 and 4', approximate planes between the gears 4 and 4' and the seal block 7, sliding contact surfaces between the side surfaces 4*a*, 4*b*, 4*a'*, and 4*b'* of the gears 4 and 4' and the side plates 6 and 6', contact surfaces between the seal block 7 and the side plates 6 and 6', and contact surfaces between the end surface of the pump assembly 10 and the front case 11 and the rear case 12. The seal members 8 and 8' are used to define the intake port 19 and the discharge port 20 to prevent communication of the liquid between the intake port 19 and the discharge port 20 when differential pressure occurs between the periphery of the intake port 19 and the periphery of the discharge port 20. The inside of the seal members 8 and 8' is a low-pressure area and the outside of the same is a high-pressure area.

Next, the seal members 8 and 8' for use in the present embodiment will be described. To bring the seal members 8 and 8' into close contact with the side plates 6 and 6' and the inner surface of the case 13 (the front case 11 or the rear case 12) when the gear pump 1 is assembled, the seal member 8 and 8' are higher than the gap between the steps 6*a* and 6*a'* of the side plates and the front case 11 or the rear case 12 (vertical direction in FIG. 2). Accordingly, after the assembly of the gear pump 1, the seal members 8 and 8' are crushed in the direction of the drive axis, and are brought into close contact with side plates 6 and 6', the front case 11, and the rear case 12 with generation of a contact surface pressure.

When the seal member 8 for use in the present embodiment is seen from the direction illustrated in FIG. 1, a portion 81 passing through the position corresponding to the engaged portion between the gears 4 and 4' and a portion 82 nearer the rotation center of the gear than the section sealed by the side plates 6 and 6' and the seal block 7 in contact with each other and passing through the position where the liquid in the intake port 19 is sent to the high-pressure area, have cross sections that are widened toward the outsides of the steps 6*a* and 6*a'* of the side plates 6 and 6' and the outsides of the steps 7*b* and 7*b'* of the seal block, as compared to other portions (portions 83 and 84 without or with less pressure fluctuation). The seal member 8 may be widened not only at the position corresponding to the actually engaged portion between the gears 4 and 4' as illustrated in FIG. 1 but also in the area in which the tooth tips of the gears 4 and 4' come closer to each other with rotation. The portion 82 of the seal member 8 may be widened, as illustrated in the wider portion of the seal member 8 in FIG. 1, at the position nearer the rotation center of the gear from the contact portion between the seal block 7 and the side plates 6 and 6' is widened by a certain length along the outline of the seal member 8.

Figure 6:
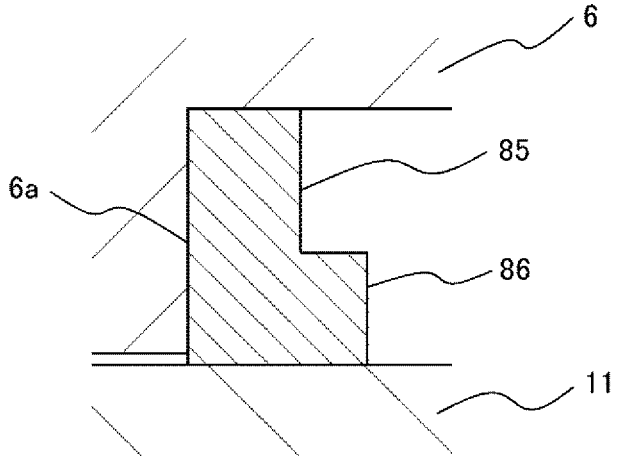
FIG. 6 is an enlarged view of a section F of the gear pump illustrated in FIG. 2, which represents the state of the seal member after assembly of the pump that is applied to the gear pump in the first embodiment.

The portions 83 and 84 of the seal member 8 have an L-shaped cross section as illustrated in FIG. 6 (equivalent to a section F surrounded by dotted lines in the seal member 8 of FIG. 2 and the cross section of the portion 84 of the seal member 8), for example, and a thin portion 85 is provided to reduce force of pressing the side plate 6 to the gears 4 and 4' generated by the seal member 8 when the seal member 8 is crushed. In the present embodiment, the thin portion of the seal member is formed at the side plate 6 side and a thick portion 86 of the same is formed at the front case 11 side. Alternatively, the thick portion of the seal member may be formed at the side plate 6 side, and the thin portion 86 may be formed at the front case 11 side.

Figure 7:
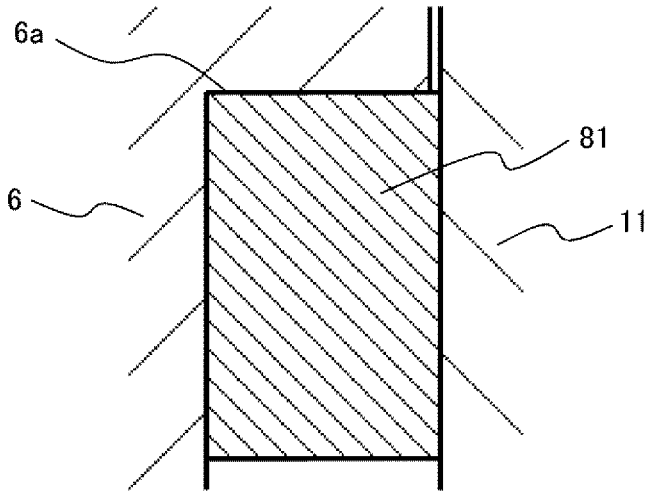
FIG. 7 is an enlarged view of a section G of the gear pump illustrated in FIG. 5, which represents the state of the seal member after assembly of the pump that is applied to the gear pump in the first embodiment.

Meanwhile, the seal member 8 is widened at the portions 81 and 82 of the seal member 8 on the outside of the step 6*a* (the downward direction of FIG. 7) as illustrated in FIG. 7 (a portion G of the seal member 8 surrounded by the dotted lines in FIG. 5, equivalent to the cross section of the portion 81 of the seal member 8). Accordingly, the portion 81 has larger force of pressing the side plate 6 toward the gears 4 and 4' as compared to the portions 83 and 84. In other words, in the present embodiment, the seal member is made with larger force of pressing the side plate 6 toward the gears 4 and 4' at the position (area) equivalent to the portion with larger pressure fluctuations than at the position (area) equivalent to the other portions (without or with smaller pressure fluctuations). This is realized by changing partly the width of the seal member. In the present embodiment, it is important to change partly the width of the seal member to provide the portion with larger force of pressing the side plate 6 toward the gears 4 and 4'. The range of changing partly the width is decided as appropriate depending on the magnitude of pressure fluctuations. In the present embodiment, as illustrated in FIG. 1, the width of the seal member is decreased gradually from the portion 81 to the portion 84. However, the present invention is not limited to this.

Next, operation of the gear pump 1 having the seal members 8 and 8' in the present embodiment will be described. The drive shaft 2 is driven by a drive source such as a motor (not illustrated) as described above. The gear 4 rotates integrally with the drive shaft 2. Accordingly, when the drive shaft 2 rotates in the rotational direction R1 illustrated in FIG. 3, the gear 4 also rotates in the rotational direction R1. The gear 4' engages with the gear 4 at tooth tips, and rotates integrally with the driven shaft 3. Accordingly, when the gear 4 rotates in the rotational direction R1, the gear 4' rotates integrally with the driven shaft 3 in a rotational direction R2.

When the engaged tooth tips of the gears 4 and 4' are released from each other due to the rotation, the volume of the space around the intake port 19 increases and the intake port 19 takes in liquid. By the rotation of the gears 4 and 4', the liquid around the intake port 19 is stored into the tooth grooves in the gears 4 and 4' and is transferred along the rotational directions R1 and R2 of the gears 4 and 4'. The transferred liquid flows out from the tooth grooves with the rotation of the gears 4 and 4'.

As described above, the peripheries of the intake port 19 and the discharge port 20 in the gear pump 1 are sealed by the components to avoid communication of the liquid between the intake port 19 and the discharge port 20. Accordingly, the pressure increases around the discharge port 20 by the liquid flowing out from the tooth grooves, and then the liquid is discharged from the discharge port 20.

By performing this operation continuously, the gear pump 1 is low in pressure only on the inside of the seal members 8 and 8' and is high in pressure at the other portions.

At the engaged portion between the gears 4 and 4', the gears may be in contact with each other at two places depending on the rotational angle. In this state, an area (closed area) is surrounded by the tooth tips of the two gears 4 and 4' and the side plates 6 and 6'. Due to the rotation of the gears 4 and 4', the volume of the area decreases and then increases. The volume of the closing area is small, and large pressure fluctuations are caused by a small volume change. Under the pressure, the side plates 6 and 6' are subject to large force in the direction of separation from the side surfaces of the gears 4 and 4' (vertical direction in FIG. 2). The position of the engaged portion with large pressure change is shifted from the barycenter of the side plates. As illustrated in FIG. 1, the seal member 8 has an outline asymmetric with respect to the straight lines passing through the center of the drive shaft 2 and the driven shaft 3. Therefore, when the seal member 8 is configured to have an entirely uniform cross-sectional shape and press the side plates 6 and 6' toward the gears 4 and 4' by light force, the side plates 6 and 6' may separate from the side surfaces of the gears 4 and 4' while inclining under the pressure of the engaged portions. Thus, the low-pressure area and the high-pressure area of the gear pump 1 may communicate with each other to reduce the volumetric efficiency.

The tooth tips of the gears 4 and 4' are partly sealed by the seal block 7, but a high-pressure liquid may enters a position near the intake port 19 depending on the angles of the gears 4 and 4' as illustrated in FIG. 3. Also in this case, the side plates 6 and 6' are subjected to force of separation from the side surfaces of the gears 4 and 4'. Accordingly, there are produced a gap between the side plates 6 and 6' and the gears 4 and 4', as between the engaged portions of the gears 4 and 4', which may lead to communication between the high-pressure area and the low-pressure area.

To solve the foregoing issues, the present embodiment is configured such that a portion (portion 81) of the seal member 8 at the position corresponding to the engaged portions between the gears (position just above the place with pressure change) is widened toward the outside of the step 6*a* of the side plate 6 as compared to the other portions (portions 83 and 84).

The force of the portion 81 pressing the side plate 6 is larger than those of the other portions (portions 83 and 84). For example, by designing the force generated from the portion 81 of the seal member 8 to be larger than the force resulting from pressure increase in the closed area at the engaged portions between the gears 4 and 4', the side plates 6 and 6' are not separated from the gears 4 and 4' without reduction in volumetric efficiency.

For example, when the seal member 8 is entirely widened toward the outside of the step in the side plate 6, large pressing force acts on the side plate 6 and thus no gap is produced between the side plate 6 and the gears 4 and 4'. Nevertheless, increasing partly the pressing force from the seal member 8 as in the configuration of the present embodiment makes it possible to reduce the force acting on the entire gears 4 and 4' and minimize torque increase.

As described above, the side plate 6 is supposed to lift with an inclination under increased pressure at the engaged portion of the gears 4 and 4'. Accordingly, pressing down the portion under the force of lifting makes it possible to prevent more effectively occurrence of a gap between the gears 4 and 4' and the side plate 6.

The gap between the steps in the side plate 6 or the seal block 7 and the case 13 (the front case 11 or the rear case 12) varies among individual pumps depending on manufacturing error of the side plate 6, the seal block 7, and the case 13 (the front case 11 or the rear case 12). Accordingly, when the seal member 8 is entirely widened to increase the entire pressing force of the seal member 8, driving torque of the gear pump 1 may vary among individual pumps. According to the configuration of the present embodiment, however, the seal member 8 is widened only at a portion to cause small variations in driving torque of the gear pump 1.

When the side plates 6 and 6' are formed from material with low elasticity such as resin and the seal member 8 is entirely widened to increase the pressing force, the side plates 6 and 6' may be deformed to cause insufficient force to act on the engaged portions between the gears 4 and 4'. According to the configuration of the present embodiment, however, the periphery of the engaged portions is pressed down to allow effective action of the force.

As illustrated in FIG. 1, as in the case of the engaged portions, a portion (portion 82) of the seal member 8 passing through the area nearer the rotation center of the gears 4 and 4' than the section of contact between the side plates 6 and 6' and the seal block 7 is widened at the cross section on the outsides of the steps in the side plates 6 and 6'. The seal member 8 is widened at the area nearer the rotation center of the gears 4 and 4' than the section of contact between the side plates 6 and 6' and the seal block 7 because a high-pressure liquid enters the tooth tips of the gears 4 and 4'. Accordingly, it is possible to stop lift of the side plates 6 and 6' more effectively by causing the pressing force to act on the area near the rotation center equivalent to the portions between the tooth tips and the tooth bottoms.

According to this configuration, as in the case of the engaged portions between the gears 4 and 4' described above, it is possible to increase the force of the seal member 8 pressing the side plates 6 and 6' at the place on which the force of separating the side plates acts. Accordingly, the side plates are not separated during driving of the pump without reduction in volumetric efficiency. In addition, the increase of torque can be minimized as in the case of the closed portion of the gears 4 and 4'.

The portions 81 and 82 of the seal member 8 are widened toward the outside of the groove on the side plate 6 because the force of separating the side plate 6 acts by surface and thus the portions 81 and 82 of the seal member 8 are configured to press the side plate 6 by surface. This reliably prevents lift of the side plate 6.

In the present embodiment, the cross section of the seal member 8 is widened toward the outsides of the steps in the side plates 6 and 6', at both the portion 81 corresponding to the engaged portions between the gears 4 and 4' and the portion 82 corresponding to the tooth tip seal portion. Alternatively, the cross section may be changed in width (widened) at only either one of the portions. For example, increasing the width of only the portion where larger pressure fluctuations is generated makes it possible to suppress reduction in volumetric efficiency while suppressing increase of driving torque.

Figure 8:
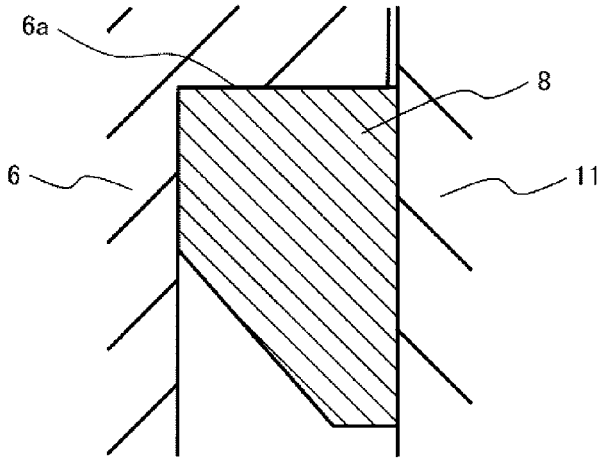
FIG. 8 is an enlarged view of the section G of the gear pump illustrated in FIG. 5, which represents the state of a seal member after assembly of the pump that has a cross-sectional shape different from that illustrated in FIG. 7 and is applied to the gear pump in the first embodiment.
Figure 9:
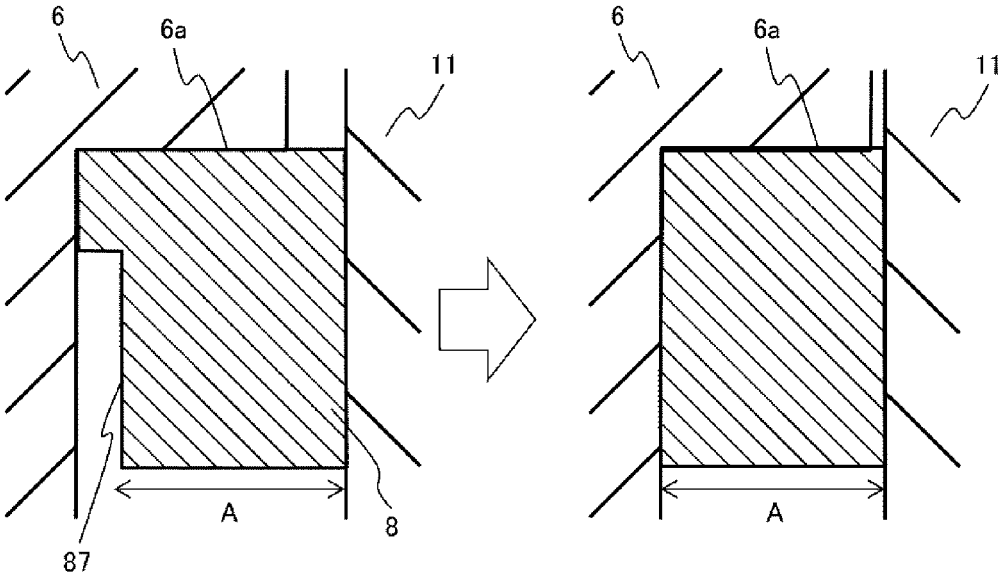
FIG. 9 is an enlarged view of the section G of the gear pump illustrated in FIG. 5, which represents the states of a seal member before and after assembly of the pump that has a cross-sectional shape different from that illustrated in FIG. 7 and is applied to the gear pump in the first embodiment.

The cross section of the portion where the seal member 8 is widened may not be widened by the same amount at the side plate 6 side and the front case 11 side as illustrated in FIG. 7, but may be partly widened between the steps in the side plates 6 and 6' and the front case 11 as illustrated in FIGS. 8 and 9 (left side), which produces almost the same advantages as described above.

The left side of FIG. 9 illustrates the cross section of the seal member 8 before the assembly of the front case 11 and the rear case 12, and the right side of FIG. 9 illustrates the cross section of the seal member 8 after the assembly of the front case 11 and the rear case 12 into the case 13. As illustrated in FIG. 9, the seal member 8 is widened toward the outside of the step in the side plate 6 by the height of the gap between the steps in the side plate 6 and the case 13 (dimension A in FIG. 9). According to this configuration, even though the side plate 6 is slightly lifted from the gears 4 and 4' at the place on which the force of separating the side plate 6 acts, force is generated at a widened portion 87 of the seal member 8 to minimize the amount of lift. This produces almost the same advantages as those of the configuration described above. In addition, in the configuration of FIG. 9, it is possible to further suppress increase of driving torque.

Also in the present embodiment, the entire seal member is formed from the same material. Alternatively, the partial material for the seal member 8 may be altered to change (increase) partly the pressing force. For instance, when the portions 81 and 82 widened toward the outsides of the steps in the side plates 6 and 6' described above in relation to the present embodiment may be formed by highly-elastic material, large force is generated at the portions 81 and 82 to press the side plates 6 and 6' against the gears 4 and 4', which produces almost the same advantages as described above.

Second Embodiment

Figure 10:
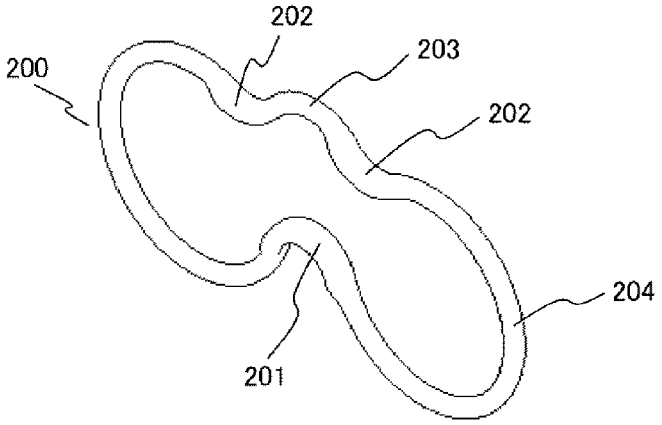
FIG. 10 is a perspective view of a seal member that is applied to a second embodiment of a gear pump according to the present invention.
Figure 11:
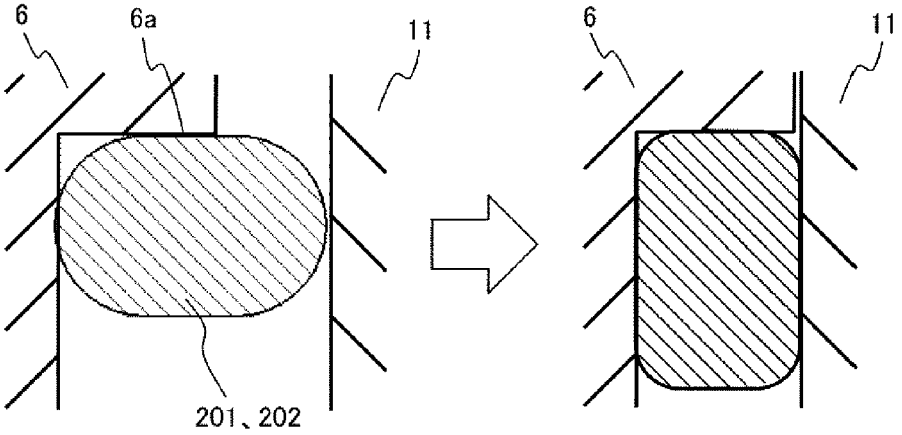
FIG. 11 is an enlarged view of the section G illustrated in FIG. 5 in the case where the seal member in the second embodiment is applied to the gear pump according to the present invention, which represents the states of the seal member before and after assembly of the pump.
Figure 12:
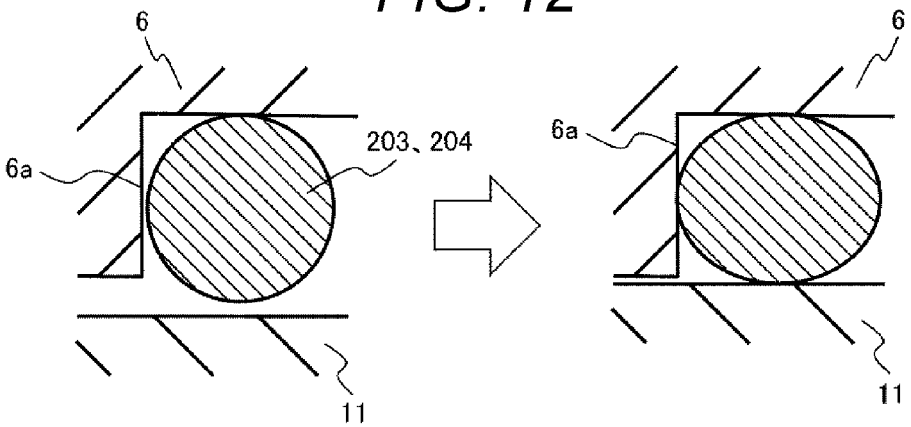
FIG. 12 is an enlarged view of the section F illustrated in FIG. 2 in the case where the seal member in the second embodiment is applied to the gear pump according to the present invention, which represents the states of the seal member before and after assembly of the pump.

A second embodiment of the present invention will be described with reference to FIGS. 10 to 12. FIG. 10 is a perspective view of a seal member that is applied to a second embodiment. FIG. 11 is an enlarged view of the section G illustrated in FIG. 5 in the case where the seal member in the second embodiment is applied, which represents the state of the seal member before assembly of the pump (left side) and the state of the seal member after assembly of the pump (right side). FIG. 12 is an enlarged view of the section F illustrated in FIG. 2 in the case where the seal member in the second embodiment is applied, which represents the state of the seal member before assembly of the pump (left side) and the state of the seal member after assembly of the pump (right side).

Configuration and operation of the gear pump 1 in the present embodiment are the same as those in the first embodiment illustrated in FIGS. 1 to 5 and descriptions thereof will be omitted. In the present embodiment, a seal member 200 is used instead of the seal members 8 and 8' at the steps 6*a* and 6*a'* of the side plates and the steps 7*b* and 7*b'* of the seal block.

The seal member 200 for use in the present embodiment is shaped as illustrated in FIG. 10 in the state before assembly into the gear pump 1. The seal member 200 has a portion 203 passing through the seal block 7 and a portion 204 passing through the teeth of the gears 4 and 4' on the side plates 6 and 6'. The seal member 200 is configured to be higher in the direction of the height of the steps in the side plates 6 and 6' at the place with pressure change described above in relation to the first embodiment, that is, at a portion 201 passing though the position corresponding to the engaged portions between the gears 4 and 4' and a portion 202 nearer the rotation center of the gears 4 and 4' than the section sealed by the contact between the side plates 6 and 6' and the seal block 7 and passing through the position where the liquid in the intake port 19 is sent to the high-pressure area (refer to the left side of FIG. 11).

The portions 201 and 202 and the portions 203 and 204 are changed in height not discontinuously but gradually as illustrated in FIG. 10, such that the higher portions and the lower portions are smoothly connected. This produces no gap between the seal member 200 and the step in the side plate 6 or the case 13 (the front case 11 and the rear case 12), which causes no leakage of the liquid from the high-pressure area to the low-pressure area.

When the pump assembly 10 is incorporated into the case 13, the portions 201 and 202 of the seal member 200 are crushed at the higher sections as illustrated in FIG. 11 to have cross sections widened toward the outside of the step in the side plate 6 to press the side plate 6 toward the gear by large force. Meanwhile, the portions 203 and 204 are lower even before the crushing as illustrated in the left side of FIG. 12, and are not widened toward the outside of the side plate 6 after the crushing (refer to the right side of FIG. 12) to have smaller force to press the side plate 6 toward the gear side.

According to this configuration, the seal member 200 can generate force to prevent separation of the side plates 6 and 6' from the side surfaces of the gears 4 and 4' at the place with pressure fluctuations resulting from the rotation of the gears 4 and 4', as in the case of the seal member 8 in the first embodiment. Accordingly, there is no gap between the side plate 6 and the gears 4 and 4', which makes it possible to obtain almost the same advantages as those of the first embodiment without reduction in volumetric efficiency.

In the present embodiment, as in the first embodiment, the portions 201 and 202 of the seal member 200 are widened toward the outsides of the side plates 6 and 6' after the assembly of the pump. This reliably prevents the lift of the side plate 6 against the force of separation acting on the side plate 6 by surface.

In the present embodiment, as in the first embodiment, since only portions of the seal member 200 cause large force to act on the side plates 6 and 6', the increase of driving torque of the gear pump 1 can be minimized.

Taking the first and second embodiments into account, it can be said that, in the present invention, a portion of the seal member has a cross section of a surface normal to the outline of the seal member and perpendicular to the opposed case and side plate, that is different in shape from those of the other portions of the seal member. In other words, it can be said that, in the present invention, the seal cross section at a portion of the seal member cut along the direction of the height of the step or the depth of the groove (depth of the notch) and the direction perpendicular to the longitudinal side of the seal member, is different in shape from those at the other portions of the seal member.

Third Embodiment

Figure 13:
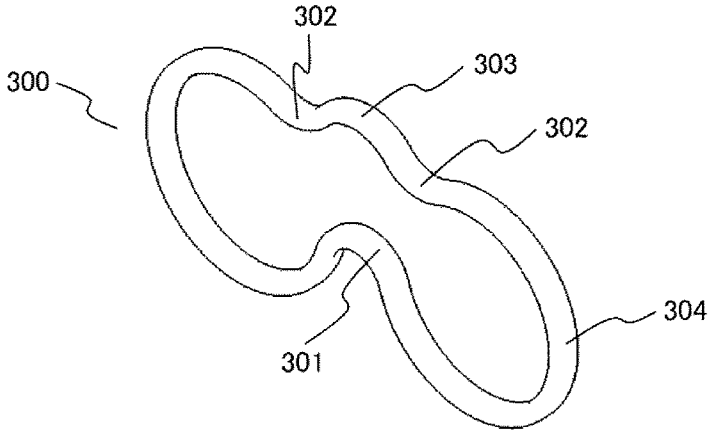
FIG. 13 is a perspective view of a seal member that is applied to a third embodiment of a gear pump according to the present invention.
Figure 14:
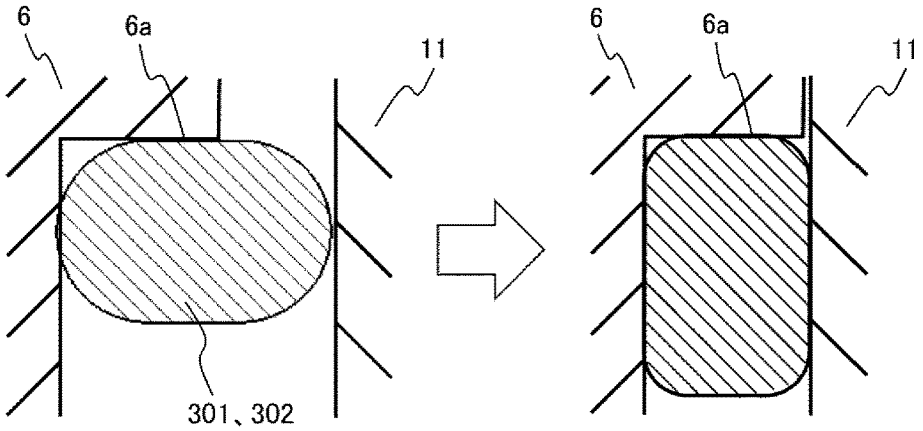
FIG. 14 is an enlarged view of the section G illustrated in FIG. 5 in the case where the seal member in the third embodiment is applied to the gear pump according to the present invention, which represents the states of the seal member before and after assembly of the pump.
Figure 15:
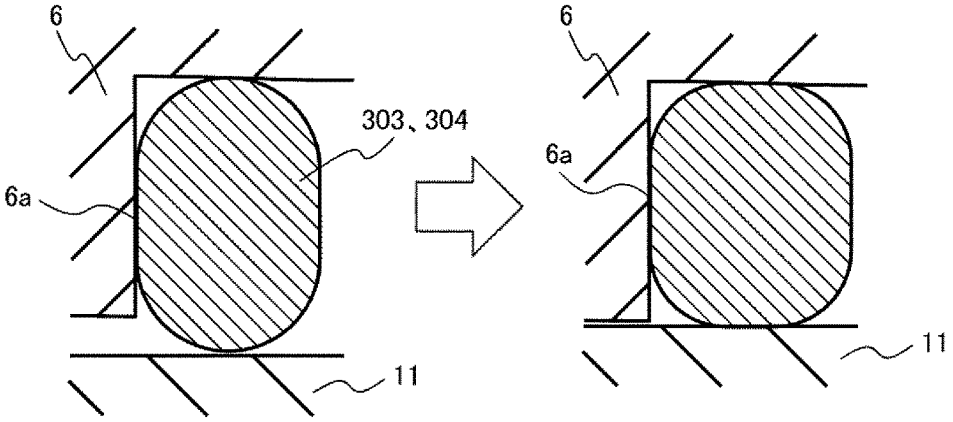
FIG. 15 is an enlarged view of the section F illustrated in FIG. 2 in the case where the seal member in the third embodiment is applied to the gear pump according to the present invention, which represents the states of a seal member before and after assembly of the pump.

The second embodiment of the present invention will be described with reference to FIGS. 13 to 15. FIG. 13 is a perspective view of a seal member that is applied to a third embodiment. FIG. 14 is an enlarged view of the section G illustrated in FIG. 5 in the case where the seal member in the third embodiment is applied, which represents the state of the seal member before assembly of the pump (left side) and the state of the seal member after assembly of the pump (right side). FIG. 15 is an enlarged view of the section F illustrated in FIG. 2 in the case where the seal member in the third embodiment is applied, which represents the state of the seal member before assembly of the pump (left side) and the state of the seal member after assembly of the pump (right side).

Configuration and operation of the gear pump 1 in the present embodiment are the same as those in the first embodiment illustrated in FIGS. 1 to 5 and descriptions thereof will be omitted. In the present embodiment, a seal member 300 is used instead of the seal members 8 and 8' at the steps 6*a* and 6*a*' of the side plates and the steps 7*b* and 7*b*' of the seal block. In addition, the steps 6*a* and 6*a*' of the side plates and the steps 7*b* and 7*b*' of the seal block are partly changed (reduced) in height.

The seal member 300 in the present embodiment is formed to have a cross section made uniform in the axial direction of the pump as illustrated in FIG. 13. Meanwhile, in the present embodiment, the steps 6*a* and 6*a*' of the side plates are partly changed in height. The steps in the side plates 6 and 6' or the seal block 7 in contact with portions of the seal member passing through the place with pressure change, that is, a portion 301 passing through the position corresponding to the engaged portions between the gear 4 and 4' and a portion 302 nearer the rotation center of the gears 4 and 4' than the section sealed by contact between the side plates 6 and 6' and the seal block 7 and passing through the position where the liquid in the intake port 19 is sent to the high-pressure area, are decreased in height.

Also in this case, no gap is produced between the seal member 300, and the steps in the side plates 6 and 6' or the seal block 7 and the case 13 (the front case 11 and the rear case 12) by connecting smoothly the portions with lower steps where the portions 301 and 302 of the seal member are placed and the portions with higher steps where the portions 303 and 304 of the seal member are placed to prevent leakage of the liquid.

As illustrated in FIG. 14, the steps in the side plate 6 are lower at the portions 301 and 302 of the seal member 300 and a large amount of the seal member 300 is crushed at these portions. As illustrated in the right side of FIG. 14, the portions 301 and 302 are widened toward the outsides of the steps in the side plate 6 while pressing the side plate 6 toward the gear by larger force. Meanwhile, as illustrated in FIG. 15, the steps in the side plate 6 are higher at the portions 303 and 304 of the seal member and a small amount of the seal member 300 is crushed at these portions. The portions 303 and 304 of the seal member 300 are hardly widened toward the outsides of the steps in the side plate 6. Accordingly, the portions 303 and 304 of the seal member press the side plate 6 toward the gear by smaller force.

According to this configuration, as with the seal member 8 in the first embodiment, it is possible to generate force of preventing the side plates 6 and 6' from being separated from the side surfaces of the gears 4 and 4' at the place with pressure fluctuations resulting from the rotation of the gears 4 and 4'. Accordingly, there is produced no gap between the side plate 6 and the gears 4 and 4' without reduction in volumetric efficiency, which makes it possible to produce almost the same advantages as those of the first embodiment.

In the present embodiment, as in the first embodiment, after the assembly of the pump, the portions 301 and 302 of the seal member 300 are widened toward the outsides of the side plates 6 and 6', which makes it possible to stop reliably the lift of the side plate 6 against the force of separation acting on the side plate 6 by surface.

In the present embodiment, as in the first embodiment, since only portions of the seal member 300 cause large force to act on the side plates 6 and 6', the increase of driving torque of the gear pump 1 can be minimized.

In the present embodiment, the seal member is uniformly shaped to facilitate the formation of the seal member.

Fourth Embodiment

A fourth embodiment of the present invention will be described with reference to FIGS. 16 and 17. Configuration and operation of the gear pump 1 in the present embodiment are the same as those in the first embodiment illustrated in FIGS. 1 to 5 and descriptions thereof will be omitted. In the present embodiment, a seal member 400 is used instead of the seal members 8 and 8' at the steps 6*a* and 6*a*' of the side plates and the steps 7*b* and 7*b*' of the seal block.

The side plates 6 and 6' constituting the gear pump 1 in the present embodiment have thin cross sections or are formed from low-rigidity material such as resin. In the case of these side plates 6 and 6', even though the side plates 6 and 6' are fabricated with high precision, the surfaces of the side plates 6 and 6' to be in contact with the gears 4 and 4' may not be perfectly flat or the side plates 6 and 6' may be curved after the processing due to processing limitation. Accordingly, when the gear pump 1 is assembled, the side plates 6 and 6' and the gears 4 and 4' may not perfectly contact each other by the contact surfaces. In this state, when the gear pump 1 is driven, the high-pressure area and the low-pressure area communicate each other through the gap to reduce the volumetric efficiency.

Figure 17:
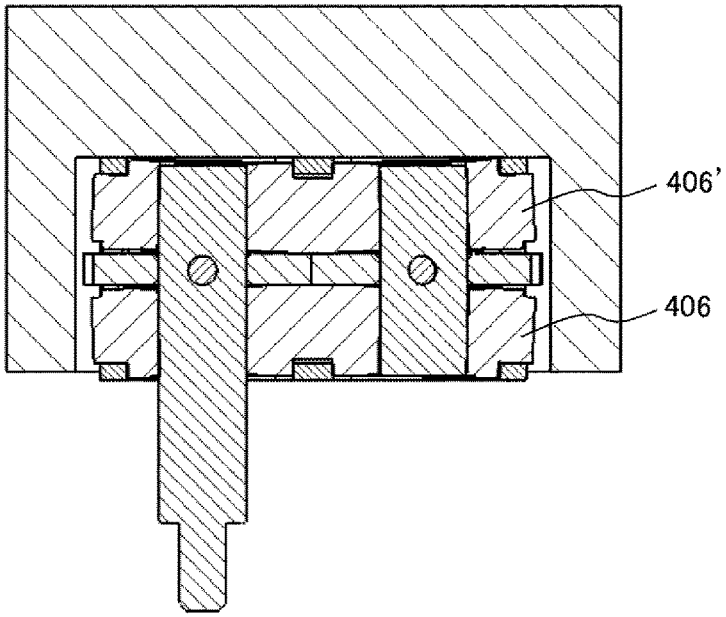
FIG. 17 is a cross-sectional view of the gear pump illustrated in FIG. 16 taken along line H-H.

It is assumed in the present embodiment that the gear pump is configured as illustrated in FIG. 17, for instance, such that side plates 406 and 406' are curved in U shape to have contact surfaces relative to the gears 4 and 4' lifted at the right and left ends of the side plates 406 and 406'. The curves in the side plates result from the used manufacturing method, and thus almost the same curves would be generated with the use of the same manufacturing method.

Figure 16:
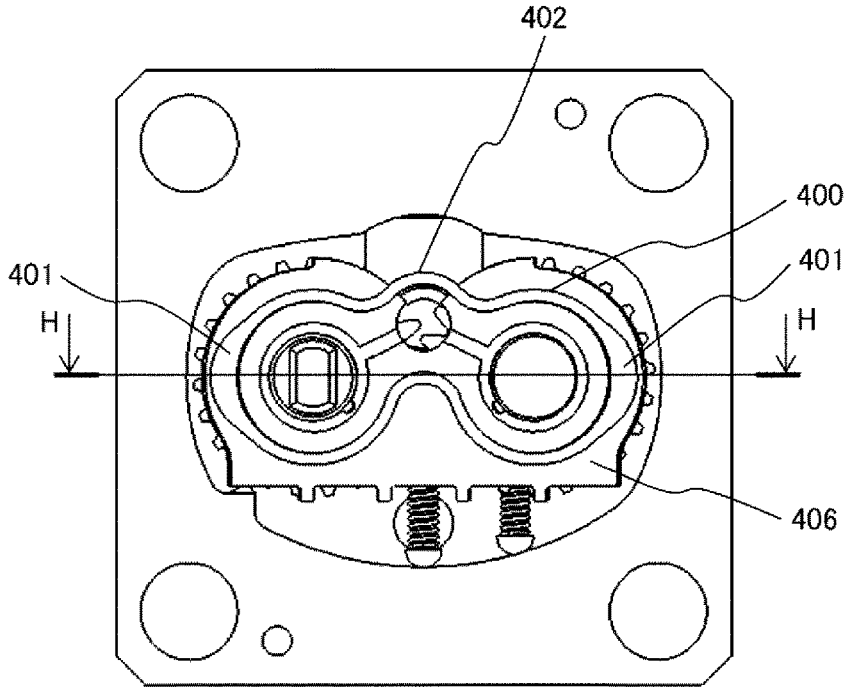
FIG. 16 is a diagram illustrating a configuration of a fourth embodiment of a gear pump according to the present invention, which is seen from a position perpendicular to a gear side surface before a case is closed.

In this case, as illustrated in FIG. 16, portions (portions 401) of the seal member passing through the positions corresponding to the gaps resulting from the curve between the contact surfaces between the side plates 406 and 406' and the gears 4 and 4', has a cross section widened toward the outsides of the side plate steps. For example, as illustrated in FIG. 16, the seal member 400 is widened toward the outsides of the steps in the side plates 406 and 406' at most lifted right and left ends of the side plates 406 and 406'.

As described above, in the gear pump 1 of the present embodiment, portions (portions 401) of the seal member 400 in the same positions as the portions of the side plates 406 and 406' lifted from the gears 4 and 4' provide large force to the side plates 406 and 406'. Accordingly, the side plates 406 and 406' are deformed to come into close contact with the side surfaces of the gears 4 and 4'. As a result, it is possible to reduce liquid leakage during operation of the gear pump 1.

As with the seal member in the first embodiment, changing the cross section of the portions partly in the present embodiment makes it possible to reduce the force of pressing the side plates 406 and 406' and minimize increase of frictional force as compared with the case where the cross section of the seal member 400 is entirely widened toward the outsides of the steps or the grooves in the side plates as in the portions 401.

When the entire seal member 400 is made the same in width as the portions 401 to eliminate a warp in the side plate 6 by deformation, the heights of the steps in the side plates 406 and 406', the height of the case 13, and the like vary among individual pumps due to manufacturing error or the like, and the force of the seal member 400 pressing the side plates also varies among individual pumps due to the height variations among individual pumps. Accordingly, high friction may occur in some pumps. In the present embodiment, however, the seal member 400 is widened only at portions (portions 401), and there occurs fewer variations in friction even with manufacturing error in the pump components.

In the present embodiment, portions (portions 401) of the seal member are widened toward the outsides of the steps in the side plates 406 and 406' to increase partly the pressing force. Alternatively, the same advantages can be obtained by extending the portions 401 of the seal member 400 along the heights of the steps in the side plates 406 and 406' as described above in relation to the second embodiment or by changing the heights of the steps in the side plates 406 and 406' at which the portions 401 of the seal member 400 are placed as described above in relation to the third embodiment.

The present embodiment and the first embodiment may be combined with each other. Specifically, in addition to the portions 401 illustrated in FIG. 16, a portion (portion 81 in FIG. 1) passing through the place corresponding to the engaged portions between the gears may be widened.

Fifth Embodiment

A fifth embodiment relating to an actuator to which the gear pump 1 of the present invention is applied will be described with reference to FIGS. 18 and 19.

Figure 18:
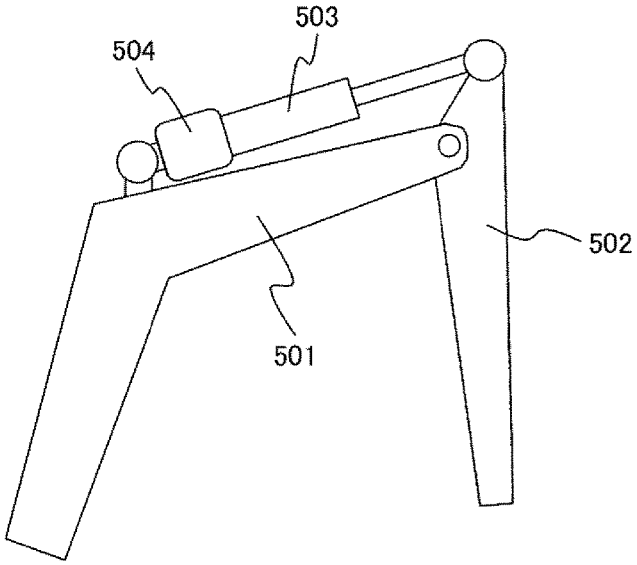
FIG. 18 is a schematic view of an arm operated by an oil-pressure control unit to which the gear pump according to the present invention is applied.

The gear pump 1 in the present embodiment is used, for instance, as an oil-pressure source for driving a cylinder 503 attached to one end of an arm 502 in construction machinery as illustrated in FIG. 18. The cylinder 503 includes an oil-pressure control unit 504 to control a supplied oil pressure. The oil-pressure control unit 504 is supported by a boom 501.

Figure 19:
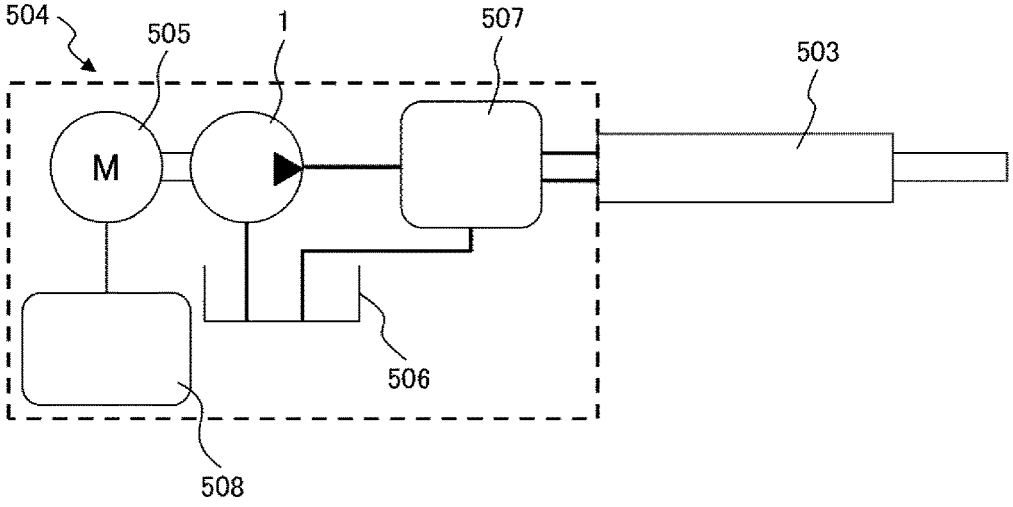
FIG. 19 is a schematic view of the oil-pressure control unit illustrated in FIG. 18.

The oil-pressure control unit 504 is composed of at least the gear pump 1, an electric motor 505, a tank 506, a valve unit 507, and a control unit 508 as illustrated in FIG. 19. Under an instruction from the operator, the electric motor 505 drives the gear pump 1 to increase the pressure of an operating oil, and the valve unit 507 decides a route for supplying the operating oil to the cylinder 503. Accordingly, the oil-pressure cylinder 503 is operated to move the arm 502.

The use of the gear pump 1 in the present invention realizes a high-volumetric efficiency pump without increasing torque, which eliminates the need to use a large-sized electric motor. Accordingly, the oil-pressure control unit 504 to be attached to the cylinder 503 can be reduced in size and easy to install.

Sixth Embodiment

A sixth embodiment relating to an actuator to which the gear pump 1 of the present invention is applied will be described with reference to FIGS. 20 and 21.

Figure 20:
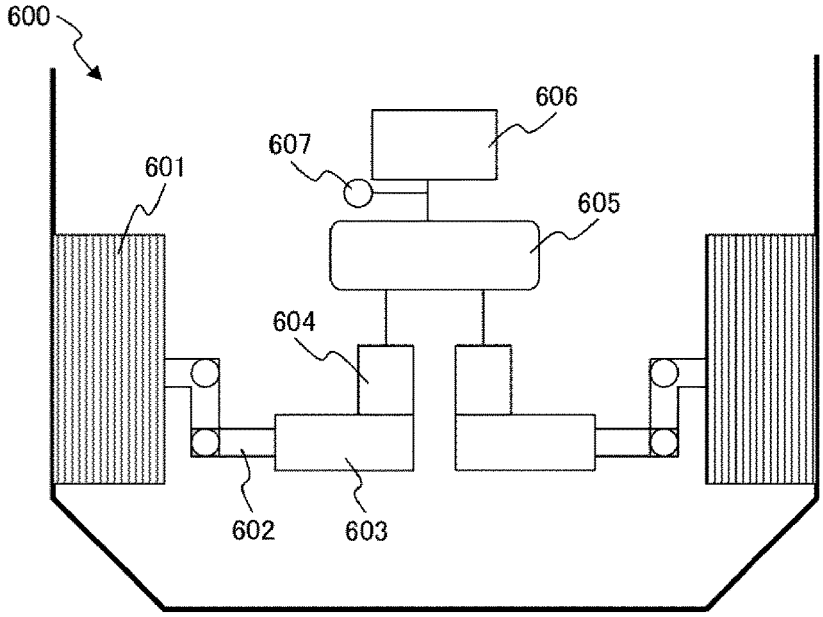
FIG. 20 is a schematic view of a steering unit operated by the oil-pressure control unit to which the gear pump according to the present invention is applied.
Figure 21:
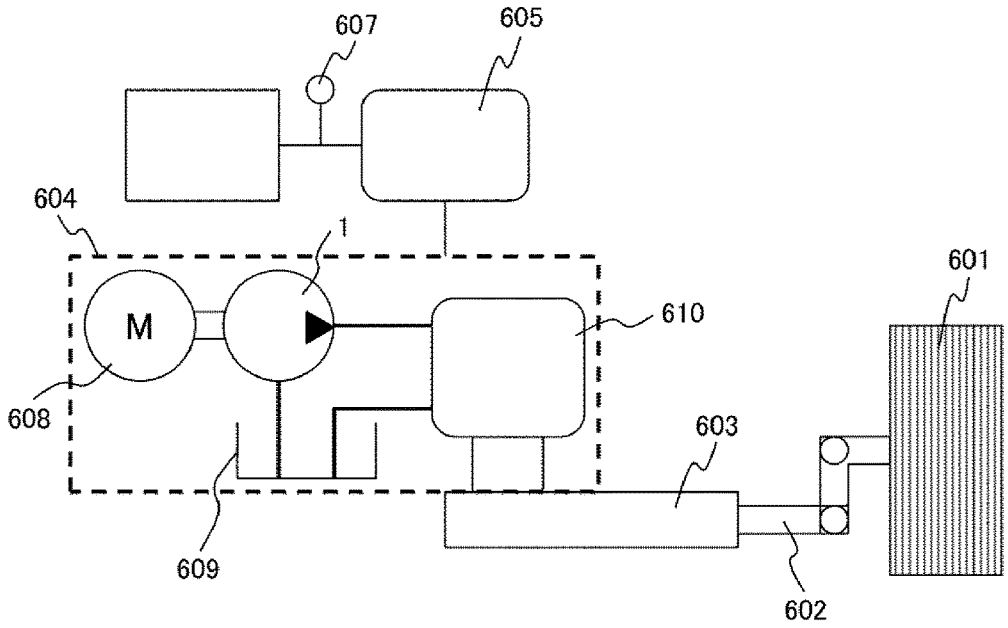
FIG. 21 is a schematic view of the oil-pressure control unit illustrated in FIG. 20.

The gear pump 1 of the present invention can be used as an oil pressure source for an actuator to steer a wheel 601 of a robot illustrated in FIG. 20, for example. As illustrated in FIG. 20, a steering unit 600 for the wheel 601 of the robot includes a cylinder 603 that extends or contracts a rod 602 by oil-pressure force to adjust a steering angle of the wheel 601, an oil-pressure control unit 604 that supplies the oil-pressure force to the cylinder 603, a control unit 605 that controls the oil-pressure control unit 604, an input device 606, and a sensor 607. The oil-pressure control unit 604 is composed of an electric motor 608, the gear pump 1, a tank 609 that supplies oil to the pump, and a valve unit 610 as illustrated in FIG. 21.

The thus configured steering unit 600 generates a control order value at the control unit 605 based on the operator's input or information from the sensor 607, and drives the electric motor 608 according to the order value to increase the pressure of the working oil by the gear pump 1. Then, the valve unit 610 is operated to decide a route for supplying the operating oil to the cylinder 603. Accordingly, the cylinder 603 is extended or contracted to adjust the steering angle of the wheel 601 attached to an end of the rod 602.

The use of the gear pump 1 in the present invention eliminates the need for a large-sized electric motor as in the present embodiment. Accordingly, the oil-pressure control unit 604 attached to the cylinder 603 can be reduced in size and easy to install.

The configuration with the use of the gear pump 1 in the present invention can be used as an oil-pressure source for actuators in various kinds of machinery such as robots, construction machines, and automobiles.

As described above, the present invention includes a wide variety of solutions. Configuration examples of the present invention applied to a gear pump are as follows:

(1) A gear pump includes: a pump assembly having gears that engage with each other and are rotated and driven by a driving source, side plates arranged adjacent to side surfaces of the gear, and a seal block that is in contact with the side plates and circumferential portions of the gears; a case that houses the pump assembly; and a seal member that is arranged along notches (steps or grooves) formed in the side plates and the seal block on sides opposite to the gears, and is in close contact with the case to define a high-pressure portion and a low-pressure portion in the case, wherein, when the pump assembly is incorporated into the case, the cross-sectional shape of a portion of the seal member normal to the outline of the seal member and perpendicular to the opposed case and side plates is different from the cross-sectional shape of another portion of the seal member.

(2) The gear pump according to (1) is configured such that the portion of the seal member with the different cross-sectional shape is situated at a position corresponding to engaged portions between the gears.

(3) The gear pump according to (1) is configured such that the portion of the seal member with the different cross-sectional shape passes through an area near the rotation centers of the gears in a section where the seal block is in contact with the side plates (also where the seal block covers circumferential portions of the gears).

(4) The gear pump according to (1) is configured such that the portion of the seal member with the different cross-sectional shape is situated at a position corresponding to a gap between the gear side surfaces and the side plates resulting from a curve in the side surfaces.

(5) The gear pump according to any of (1) to (4) is configured such that the portion of the seal member with the different cross-sectional shape has a cross section that is more widened toward the outsides of grooves or steps in the side plates or in the seal block than the other portion.

(6) The gear pump according to any of (1) to (4) is configured such that the portion of the seal member with the different cross-sectional shape has a cross section that is larger other than the other portion along the depth of the grooves or the height of the steps in the side plates.

(7) The gear pump according to any of (1) to (4) is configured such that a portion of the seal member is formed from a material with different elasticity, instead of the portion of the seal member with the different cross-sectional shape. Otherwise, a portion of the seal member has the portion of the seal member with the different cross-section shape formed from a material with further different elasticity.

(8) The gear pump according to any of (1) to (4) is configured such that, instead of the seal member, a seal member formed in an almost entirely uniform shape is used, and the grooves or steps in the side plates corresponding to the portion of the seal member with the different cross-sectional shape are formed to be shallower than the other portion.

In addition, advantages of the configuration examples of the present invention are as follows:

(1) A portion of the seal member causes a large load on the place where force of separating the side plates from the gear side surfaces acts during driving of the pump, which makes it possible to prevent the side plates from being separated from the gear side surfaces without reduction in volumetric efficiency of the pump. The force generated by the seal member is increased at a limited necessary place under influence of local pressure fluctuations of the pump, which makes it possible to prevent lift of the side plates only by causing requisite minimum force to act on the side plates. Even though the notches (steps or grooves) in the seal block or the side plates are different in height due to manufacturing error, smaller differences occur in force generated by the seal member pressing the side plates and small differences occur in driving torque among individual gear pumps, as compared to the case where the seal member is entirely changed in width of the cross section to increase the force.

(2) The present invention is particularly effective on a small-sized pump in which a small gap may result in a large reduction in volumetric efficiency and a gear pump composed of side plates as low-rigidity members such as resin, and realizes a high-efficiency gear pump. The gear pump to which the present invention is applied can be driven by a small-scale motor in a high-responsive manner and under a high pressure. This allows size reduction of the entire system including an actuator with the gear pump.

The present invention is not limited to the foregoing embodiments but includes various modifications. For instance, the foregoing embodiments described above are intended to make the present invention easy to understand, and do not necessarily include all of the configurations described above. The configuration of one embodiment may be partly replaced with the configuration of another embodiment, or the configuration of one embodiment may be added to the configuration of another embodiment. Part of the configuration of each of the embodiments may be added to the configuration of another embodiment, or may be deleted or replaced with the configuration of another embodiment.

For instance, in addition to the shapes of the seal members in the first to fourth embodiments, the portion of the seal member corresponding to the place with large pressure fluctuations may be formed from a high-elasticity material to further increase partly the pressing force. Alternatively, the seal member may have a shape in combination of the first and second embodiments. Otherwise, the shape of the seal member in the first, second, or fourth embodiments and the shape of the steps in the side plates or the like in the third embodiment may be combined together.

For instance, the present invention can be applied to a gear motor that moves gears inversely by flow of a liquid. In the foregoing embodiments, the circumscribed gear pump has a combination of two external gears. The present invention is also applicable to an inscribed gear pump with a combination of an internal gear and an external gear. Also in these cases, the same advantages as those of the foregoing embodiments can be obtained by widening the seal member at the place with pressure fluctuations, that is, at the portion corresponding to the engaged portions between the gears to increase partly the force of pressing the side plates toward the gears.

REFERENCE SIGNS LIST

1 gear pump
2 drive shaft
3 driven shaft
4, 4' gear
5 drive pin
6, 6' side plate
7 seal block
8, 8' seal member
9 knock pin
10 pump assembly

11 front case
12 rear case
13 case
14 energizing member
16 case seal
18 oil seal
19 intake port
20 discharge port
200, 300, 400 seal member

The invention claimed is:

1. A rotary fluid machine, comprising:

an assembly including a pair of gears, a side plate arranged on a side surface of the gears, and a seal block arranged to cover circumferential portions of the gears;

a case housing the assembly; and a seal member being arranged between the side plate or the seal block and the case and along a notch portion formed in the side plate or the seal block to define a high-pressure portion and a low-pressure portion in the case, wherein the seal member or the notch portion is configured such that, when the assembly is incorporated into the case, force of the seal member pressing the side plate toward the gears becomes partly larger depending on a position of the seal member, the position with the partly larger force of the seal member pressing the side plate toward the gears corresponds to an engaged portion between the gears, and an inner space and an outer space between the case and the side plate relative to the seal member are the low-pressure portion and the high-pressure portion, respectively.

2. The rotary fluid machine according to claim 1, wherein a portion of the seal member provided at the position with the partly larger force of the seal member pressing the side plate toward the gears has a cross section cut along a direction of a depth of the notch and a direction perpendicular to the longitudinal side of the seal member, the cross section at the cross section cut being different in shape from the cross section of the other portion of the seal member.

3. The rotary fluid machine according to claim 2, wherein the portion of the seal member with the different cross-sectional shape has a cross section being more widened on the outside of the notch than the other portion of the seal member.

4. The rotary fluid machine according to claim 2, wherein the portion of the seal member with the different cross-sectional shape has a cross section larger than the other portion along the depth of the notch.

5. The rotary fluid machine according to claim 1, wherein the portion of the seal member provided at the position with the partly larger force of the seal member pressing the side plate toward the gears is formed from a material with higher elasticity than elasticity of the other portion of the seal member.

6. The rotary fluid machine according to claim 1, wherein a portion of the notch provided at the position with the partly larger force of the seal member pressing the side plate toward the gears is formed to be shallower than the other portion of the notch.

7. A rotary fluid machine according to claim 1, comprising:

an assembly including a pair of gears, a side plate arranged on a side surface of the gears, and a seal block arranged to cover circumferential portions of the gears;

a case housing the assembly; and a seal member being arranged between the side plate or the seal block and the case and along a notch portion formed in the side plate or the seal block to define a high-pressure portion and a low-pressure portion in the case, wherein the seal member or the notch portion is configured such that, when the assembly is incorporated into the case, force of the seal member pressing the side plate toward the gears becomes partly larger depending on a position of the seal member, the position with the partly larger force of the seal member pressing the side plate toward the gears corresponds to an area near the rotation centers of the gears in a section where the seal block covers circumferential portions of the gears, and an inner space and an outer space between the case and the side plate relative to the seal member are the low-pressure portion and the high-pressure portion, respectively.

8. The rotary fluid machine according to claim 7, wherein a portion of the seal member provided at the position with the partly larger force of the seal member pressing the side plate toward the gears has a cross section cut along the direction of the depth of the notch and the direction perpendicular to the longitudinal side of the seal member, the cross section at the cross section cut being different in shape from the cross section of the other portion of the seal member.

9. The rotary fluid machine according to claim 8, wherein the portion of the seal member with the different cross-sectional shape has a cross section being more widened on the outside of the notch than the other portion.

10. The rotary fluid machine according to claim 8, wherein the portion of the seal member with the different cross-sectional shape has a cross section larger than the other portion along the depth of the notch.

11. The rotary fluid machine according to claim 7, wherein the portion of the seal member provided at the position with the partly larger force of the seal member pressing the side plate toward the gears is formed from a material with higher elasticity than elasticity of the other portion of the seal member.

12. The rotary fluid machine according to claim 7, wherein a portion of the notch provided at the position with the partly larger force of the seal member pressing the side plate toward the gears is formed to be shallower than the other portion of the notch.

13. A rotary fluid machine according to claim 1, comprising:

an assembly including a pair of gears, a side plate arranged on a side surface of the gears, and a seal block arranged to cover circumferential portions of the gears;

a case housing the assembly; and a seal member being arranged between the side plate or the seal block and the case and along a notch portion formed in the side plate or the seal block to define a high-pressure portion and a low-pressure portion in the case, wherein the seal member or the notch portion is configured such that, when the assembly is incorporated into the case, force of the seal member pressing the side plate toward the gears becomes partly larger depending on a position of the seal member, the position with the partly larger force of the seal member pressing the side plate toward the gears corresponds to a position with a gap formed between the side surface of the gears and the side plate in the state before the assembly is incorporated into the case, and an inner space and an outer space between the case and the side plate relative to the seal member are the low-pressure portion and the high-pressure portion, respectively.

14. The rotary fluid machine according to claim 13, wherein a portion of the seal member provided at the position with the partly larger force of the seal member pressing the side plate toward the gears has a cross section cut along the direction of the depth of the notch and the direction perpendicular to the longitudinal side of the seal member, the cross section at the cross section cut being different in shape from the cross section of the other portion of the seal member.

15. The rotary fluid machine according to claim 14, wherein the portion of the seal member with the different cross-sectional shape has a cross section being more widened on the outside of the notch than the other portion.

16. The rotary fluid machine according to claim 14, wherein the portion of the seal member with the different cross-sectional shape has a cross section larger than the other portion along the depth of the notch.

17. The rotary fluid machine according to claim 13, wherein the portion of the seal member provided at the position with the partly larger force of the seal member pressing the side plate toward the gears is formed from a material with higher elasticity than elasticity of the other portion of the seal member.

18. The rotary fluid machine according to claim 13, wherein a portion of the notch provided at the position with the partly larger force of the seal member pressing the side plate toward the gears is formed to be shallower than the other portion of the notch.

* * * * *